US011560164B2

(12) United States Patent
Okubi et al.

(10) Patent No.: US 11,560,164 B2
(45) Date of Patent: Jan. 24, 2023

(54) MOBILE UNIT CONTROL SYSTEM AND MOBILE UNIT CONTROL METHOD

(71) Applicant: TOYOTA JIDOSHA KABUSHIKI KAISHA, Toyota (JP)

(72) Inventors: Ryota Okubi, Funabashi (JP); Makoto Honda, Tokyo (JP); Masato Endo, Chofu (JP); Tadaaki Sakamoto, Tokyo (JP); Takuya Murakami, Tokyo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 259 days.

(21) Appl. No.: 16/877,637

(22) Filed: May 19, 2020

(65) Prior Publication Data

US 2021/0024107 A1 Jan. 28, 2021

(30) Foreign Application Priority Data

Jul. 26, 2019 (JP) ..... JP2019-137578

(51) Int. Cl.
*B61L 3/00* (2006.01)
*B61L 25/02* (2006.01)

(52) U.S. Cl.
CPC ..... *B61L 3/008* (2013.01); *B61L 3/006* (2013.01); *B61L 25/025* (2013.01); *B61L 25/028* (2013.01); *B61L 2205/02* (2013.01)

(58) Field of Classification Search
CPC ..... B61L 3/008; B61L 3/006; B61L 25/025; B61L 25/028; B61L 2205/02
See application file for complete search history.

(56) References Cited

U.S. PATENT DOCUMENTS

| | | | | |
|---|---|---|---|---|
| 2008/0027772 | A1* | 1/2008 | Gernega | G06Q 10/04 |
| 2016/0259341 | A1* | 9/2016 | High | H04W 4/40 |
| 2018/0164829 | A1* | 6/2018 | Oshima | G05D 1/0248 |
| 2019/0265703 | A1* | 8/2019 | Hicok | G05D 1/0242 |
| 2019/0375329 | A1* | 12/2019 | Whitt | G01C 21/3415 |

FOREIGN PATENT DOCUMENTS

| | | | |
|---|---|---|---|
| JP | 2013-182379 A | | 9/2013 |
| JP | 2016-45805 A | * | 4/2016 |
| JP | 2016-045805 A | | 4/2016 |
| JP | 2016-188787 A | | 11/2016 |
| JP | 2018-010579 A | | 1/2018 |

OTHER PUBLICATIONS

Machine Translation of takaaki's reference (JP 2016-45805 A) (Year: 2016).*

* cited by examiner

*Primary Examiner* — Peter D Nolan
*Assistant Examiner* — Tarek Elarabi
(74) *Attorney, Agent, or Firm* — Oliff PLC

(57) ABSTRACT

A mobile unit control system includes an acquisition unit configured to acquire operation information on transportation located around the traveling area of a mobile unit that a user gets on and off while the mobile unit is traveling and a setting unit configured to set the traveling route or the traveling speed of the mobile unit based on the operation information on transportation.

12 Claims, 6 Drawing Sheets

MOBILE UNIT CONTROL SYSTEM AND MOBILE UNIT CONTROL METHOD

INCORPORATION BY REFERENCE

The disclosure of Japanese Patent Application No. 2019-137578 filed on Jul. 26, 2019 including the specification, drawings and abstract is incorporated herein by reference in its entirety.

BACKGROUND

1. Technical Field

The present disclosure relates to a technique for controlling a mobile unit that persons can get on and off while the mobile unit is traveling.

2. Description of Related Art

Japanese Unexamined Patent Application Publication No. 2016-45805 (JP 2016-45805 A) discloses a fixed-route traveling assistance system in which a small mobile unit that users can get on and off travels in a town or a shopping mall for assisting users in a fixed-route traveling around there. This fixed-route traveling assistance system includes a closed loop road passing through a plurality of preset points and a plurality of small mobile units that travel on the closed loop road at a low speed.

SUMMARY

The small mobile unit disclosed in JP 2016-45805 A travels on a closed loop road passing through a plurality of points. However, depending on the situation of a passing point, it may not be appropriate to continue traveling without considering the situation.

The present disclosure provides a technique for controlling the traveling of a mobile unit according to the situation of a traveling area.

A first aspect of the disclosure relates to a mobile unit control system including an acquisition unit and a setting unit. The acquisition unit is configured to acquire operation information on transportation located around the traveling area of a mobile unit that a user gets on and off while the mobile unit is traveling. The setting unit is configured to set the traveling route or the traveling speed of the mobile unit based on the operation information on transportation.

A second aspect of the disclosure relates to a mobile unit control method. This method includes acquiring and setting. In the acquiring, the operation information on transportation located around the traveling area of a mobile unit that a user gets on and off while the mobile unit is traveling is acquired. In the setting, the traveling route or the traveling speed of the mobile unit is set based on the operation information on transportation.

The present disclosure provides a technique for controlling the traveling of a mobile unit according to the situation of a traveling area.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
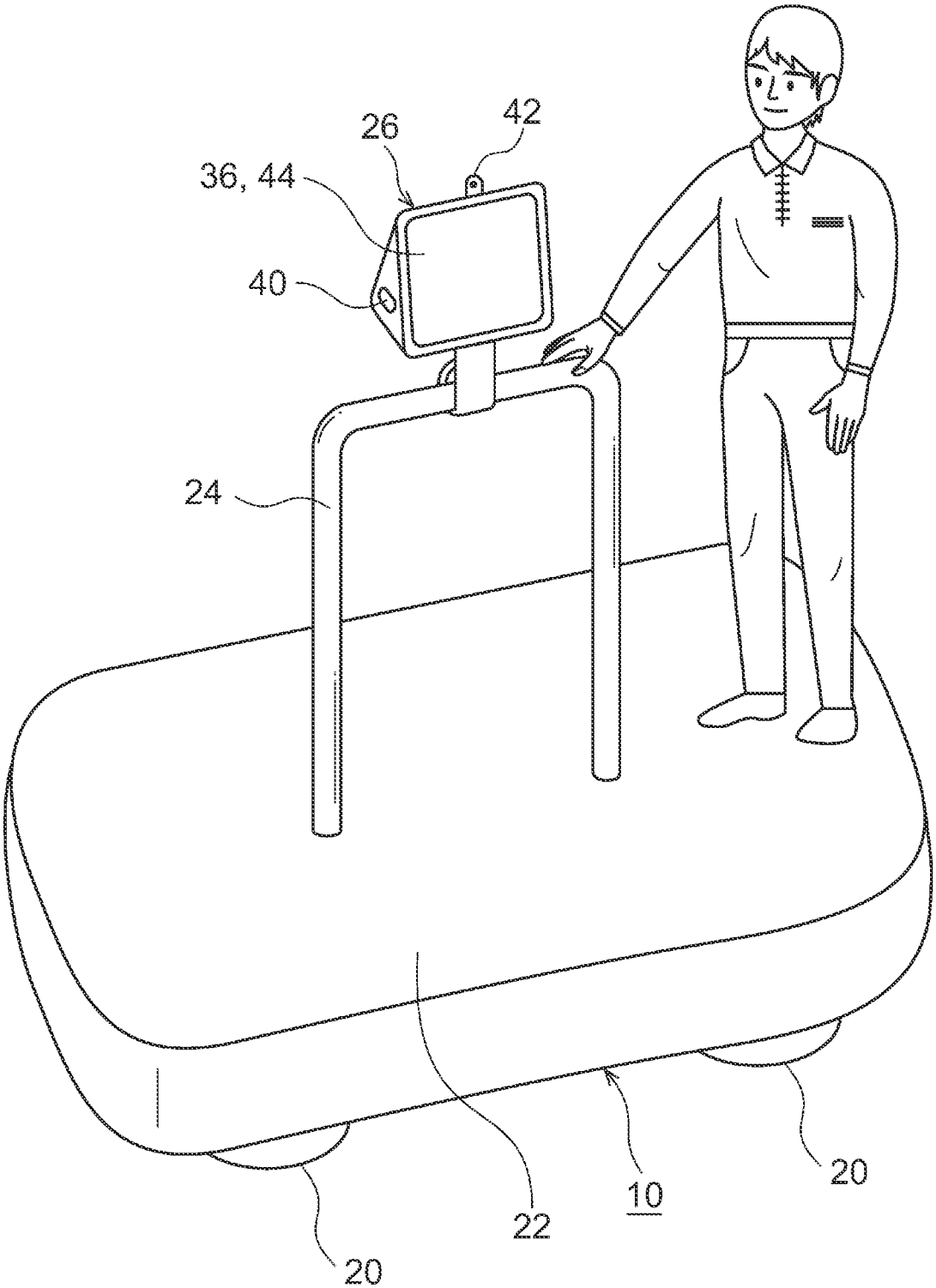
FIG. 1 is a perspective view of a mobile unit of an embodiment.

FIG. 1 is a perspective view of a mobile unit 10 in an embodiment. FIG. 1 shows the state in which an occupant gets on the mobile unit 10. The mobile unit 10 can travel automatically on a walking path or in an open space at a speed of about 3 km/h to 5 km/h. The mobile unit 10 travels on the surface of a road with pedestrians at about the same speed as pedestrians, so that users can get on and off freely while the mobile unit 10 is traveling. The mobile unit 10 travels around a plurality of facilities around a station square or in an amusement park, or travels between a station and an event site through a predetermined route. In addition, the mobile unit 10 may travel with commercial products that the occupants will purchase. The traveling path of the mobile unit 10 is not limited to the outdoors but may be in an event site or in a facility.

The mobile unit 10 includes wheels 20, a vehicle body 22, a handrail 24, and an information processing device 26. The information processing device 26 includes a reception unit 36, a short-range wireless communication unit 40, a capturing unit 42, and an output unit 44. The wheels 20, composed of four wheels, are rotated by a motor provided on the vehicle body 22. The vehicle body 22 has a platform formed in a substantially flat shape so that a user can get on and off while the mobile unit 10 is traveling. This platform is large enough to carry about four to six occupants who stand up. A motor, a battery, and a travel control device are housed inside the vehicle body 22.

The handrail 24 has a pair of columns erected from the vehicle body 22 and a horizontal bar connecting the pair of columns. An occupant holds the handrail 24 to stabilize the riding posture. The handrail 24 has the information processing device 26 fixed thereon. The reception unit 36 and the output unit 44 of the information processing device 26 are implemented by a display panel capable of touch input. The reception unit 36 receives an input by an occupant, and the output unit 44 outputs information to the occupants and nearby pedestrians.

The capturing unit 42 is a camera that captures the surroundings. The short-range wireless communication unit 40 communicates with mobile terminals and IC cards. Furthermore, the information processing device 26 is provided with a communication unit that communicates with the server device. The communication unit of the mobile unit 10 sends reception information, received by the reception unit 36, to the server device and receives information from the server device.

Figure 2:
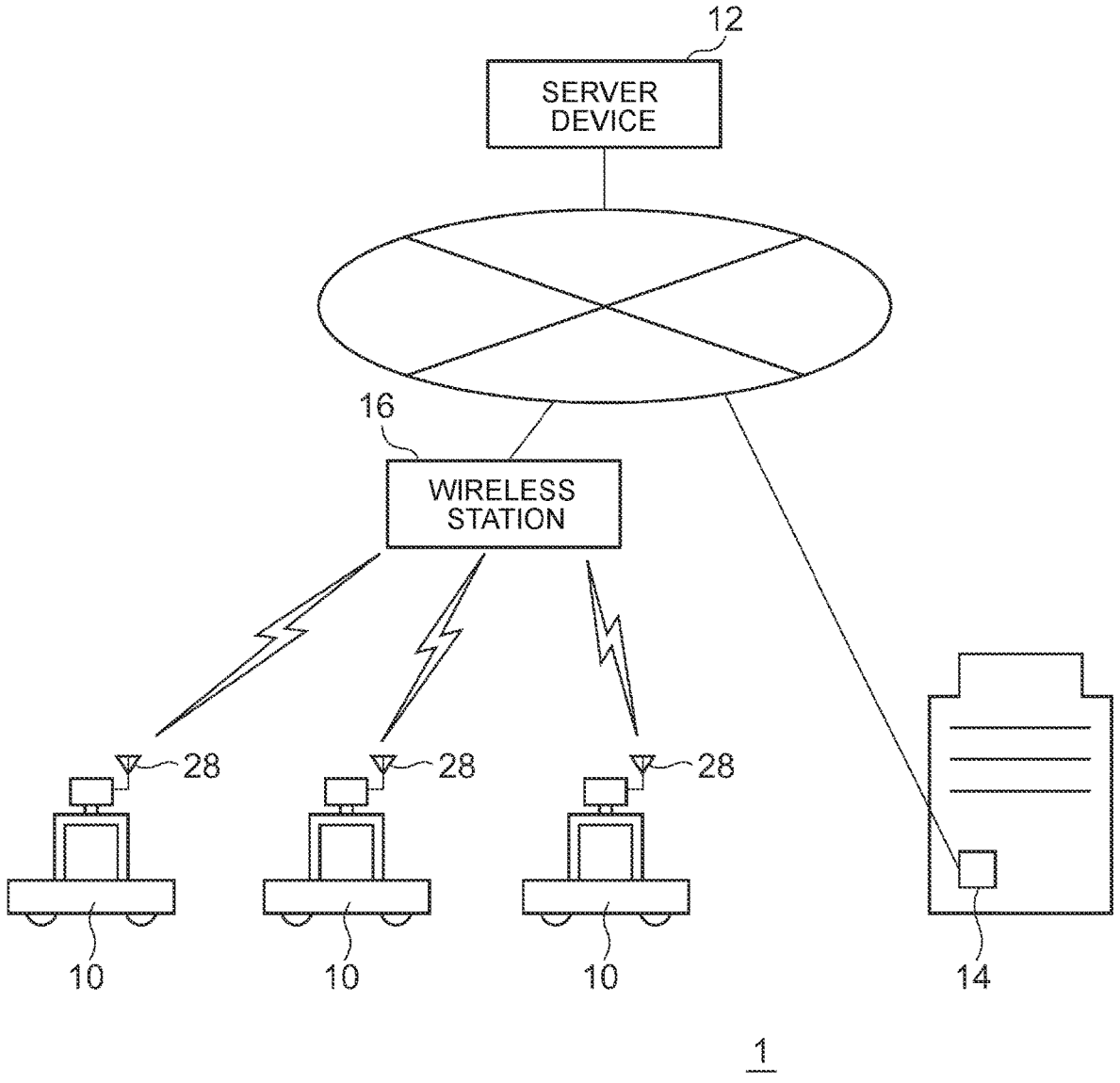
FIG. 2 is a diagram showing the outline of a configuration of a mobile unit control system in the embodiment.

FIG. 2 shows the outline of a configuration of a mobile unit control system 1 in the embodiment. The mobile unit control system 1 includes the mobile units 10, a server device 12, a traffic information holding device 14, and a wireless station 16. The server device 12 and the wireless station 16 may be connected via a network such as the Internet. The communication unit of the mobile unit 10, with the wireless communication function, is connected to the server device 12 via the wireless station 16 that is a base station.

In the mobile unit control system 1, the number of the mobile units 10 is not limited to three as shown in FIG. 2 but a large number of the mobile units 10 may generate reception information and periodically send the generated reception information to the server device 12. The server device 12, installed in a data center, receives the reception information sent from the communication unit 28 of the mobile unit 10.

The traffic information holding device 14, which holds traffic information, provides the server device 12 with the traffic information. The traffic information includes the operation information on transportation such as trains, Shinkansen, and the like. For example, the traffic information includes the information such as the information on train departure times, train suspension, operation cancellation, and delay for each train line and each station.

Figure 3:
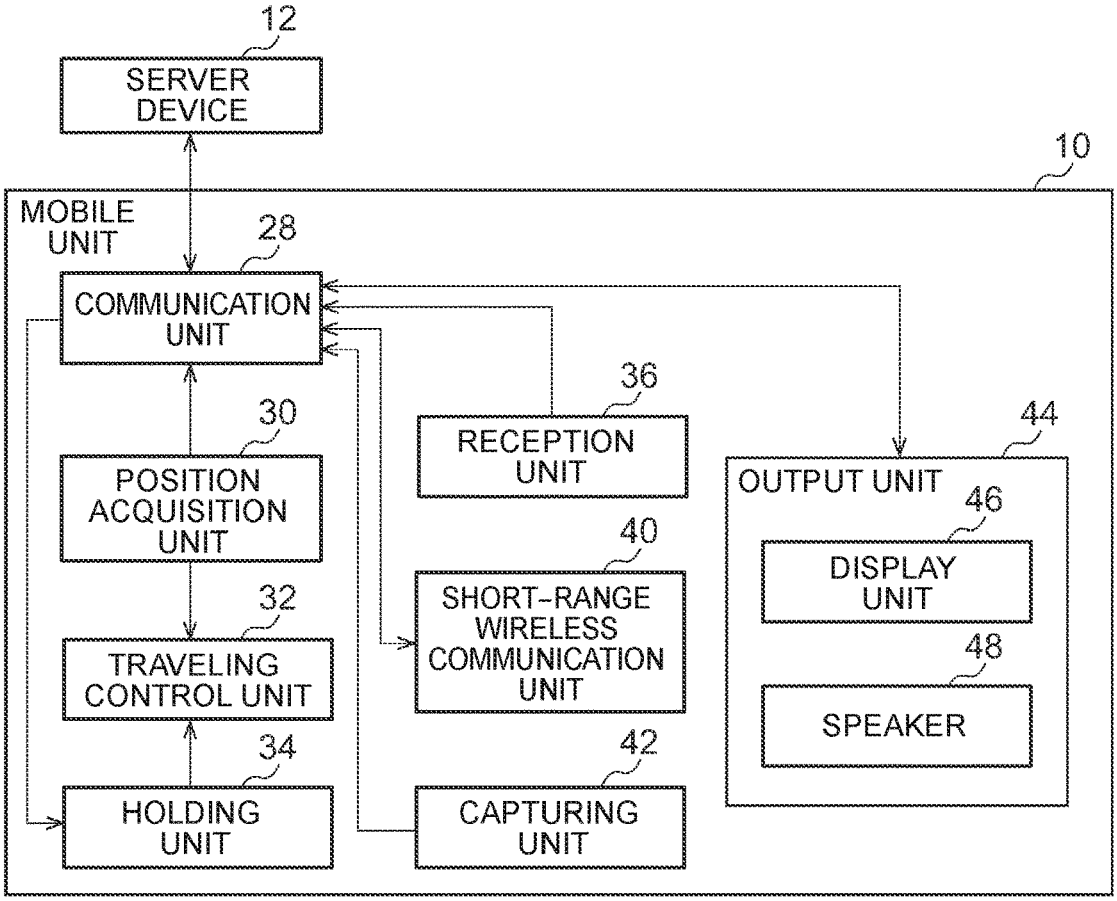
FIG. 3 is a diagram showing a functional configuration of the mobile unit of the mobile unit control system.
Figure 4:
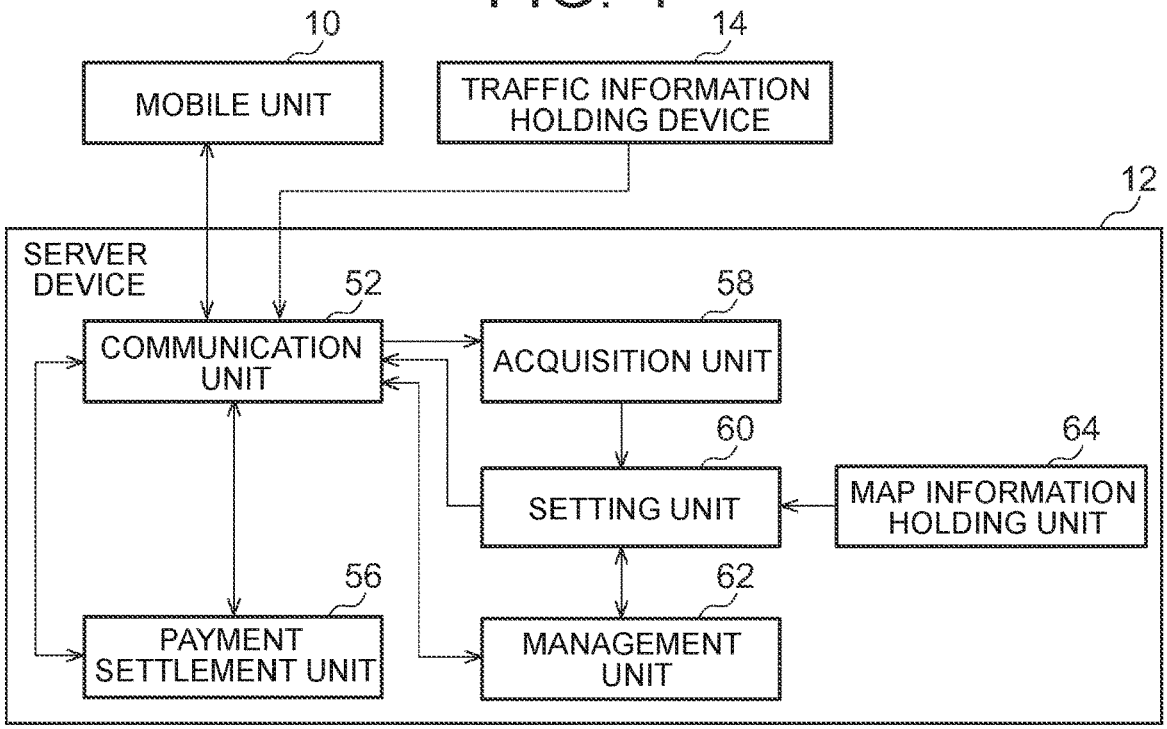
FIG. 4 is a diagram showing a functional configuration of a server device of the mobile unit control system.

FIG. 3 shows a functional configuration of the mobile unit 10 of the mobile unit control system 1. In FIG. 3 and FIG. 4 that will be described later, the components are illustrated as functional blocks that perform various types of processing. The hardware of these components is configured by circuit blocks, memories, or other LSIs, while the software of these components is implemented by programs loaded into the memory. Therefore, it is understood by those skilled in the art that these functional blocks can be implemented in various forms by hardware only, software only, or a combination hardware and software. These functional blocks may be implemented in any one of them.

The mobile unit 10 includes a communication unit 28, a position acquisition unit 30, a traveling control unit 32, a holding unit 34, the reception unit 36, the short-range wireless communication unit 40, the capturing unit 42, and the output unit 44. Each function of the mobile unit 10 is provided in the vehicle body 22 and the information processing device 26.

The communication unit 28 communicates information with the server device 12. The information sent from the communication unit 28 is provided with a vehicle ID so that the server device 12 can identify the mobile unit 10.

The position acquisition unit 30 acquires the position information on the vehicle and the acquisition time of the position information using the global positioning system (GPS). The position information on the vehicle is used by the traveling control unit 32 for traveling control and by the server device 12 for the deriving a traveling route.

The holding unit 34 holds the traveling information used by the traveling control unit 32 for traveling control. The traveling information determines the traveling route on which the mobile unit 10 is to travel and the traveling speed at which the mobile unit 10 is to travel. The traveling information may be held in the holding unit 34 in advance or may be set by the server device 12. In either case, the traveling information is held in the holding unit 34. A plurality of types of traveling information may be held, in which case the traveling information may be set to one of the plurality of types of traveling information according to the time zone or the day of the week. The capturing unit 42 captures the surroundings of the mobile unit 10 to acquire the captured image.

The traveling control unit 32 controls the traveling of the mobile unit 10 based on the traveling information. The traveling control unit 32 controls the steering angle and the traveling speed of the mobile unit 10 so that the mobile unit 10 will travel according to the traveling route and the traveling speed determined by the traveling information using the position information and the captured image. The traveling control unit 32 may control the traveling of the mobile unit 10 in such a way that, based on the traveling environment information obtained from the captured image, the mobile unit 10 stops before a pedestrian or avoids or approaches a pedestrian as long as the mobile unit 10 does not deviate from the traveling route by more than a predetermined interval.

The reception unit 36 receives an input from an occupant via the display panel capable of touch input or via a microphone. Furthermore, the reception unit 36 receives an input that indicates the destination of an occupant.

The short-range wireless communication unit 40 performs wireless communication over several centimeters to acquire payment settlement information from an occupant's mobile terminal or an occupant's card. The short-range wireless communication unit 40 may also be configured to enable wireless communication over several meters, using a communication standard such as Bluetooth (registered trademark), for communication with an occupant's mobile terminal. In addition, the short-range wireless communication unit 40 may be capable of sending and receiving information to and from a mobile terminal. In this case, when sending information to a mobile terminal, the short-range wireless communication unit 40 functions as the output unit 44.

The output unit 44 outputs information to the occupants or to the pedestrians around the mobile unit 10. The output unit 44 includes a display unit 46 and a speaker 48. The display unit 46 displays the information on the facilities located in the traveling area of the mobile unit 10, the information on the commercial products sold on the mobile unit 10, and the like. The display unit 46 may pass information to an occupant's mobile terminal by displaying a QR code (registered trademark). The speaker 48 outputs, by voice, the information on seeing spots in the traveling area of the mobile unit 10 and the information on the commercial products sold on the mobile unit 10.

The output unit 44 may be provided not only in the mobile unit 10 but also in the server device 12. For example, the server device 12 may send output information to an occupant's mobile terminal identified by the short-range wireless communication unit 40.

FIG. 4 shows a functional configuration of the server device 12 of the mobile unit control system 1. The server device 12 includes a communication unit 52, a payment settlement unit 56, an acquisition unit 58, a setting unit 60, a management unit 62, and a map information holding unit 64.

The communication unit 52 communicates with the mobile unit 10 and the traffic information holding device 14. The payment settlement unit 56 settles the price of a commercial product that the user has purchased on the mobile unit 10. The payment settlement unit 56 receives the payment settlement information received by the short-range wireless communication unit 40 of the mobile unit 10 and settles the price of the purchased commercial product.

The management unit 62 manages a plurality of mobile units 10. The management unit 62 holds the position information on the mobile units 10 and the traveling information on the mobile units 10 in association with the vehicle ID. The management unit 62 manages the position information and the traveling information in this manner to recognize a plurality of mobile units 10 traveling in a predetermined traveling area.

The acquisition unit 58 acquires the operation information on transportation, the captured image captured by the capturing unit 42 of the mobile unit 10, and the destination information on an occupant who gets on the mobile unit 10. The operation information on transportation is acquired from the traffic information holding device 14. The occupant's destination information may be input to the reception unit 36 of the mobile unit 10 or may be acquired from the mobile terminal of the occupant.

The setting unit 60 sets the traveling information that determines the traveling route and/or the traveling speed of the mobile unit 10. Based on the operation information on transportation, the setting unit 60 sets the traveling route and/or the traveling speed included in the traveling information. For example, when the operation information on transportation indicates that the operation of a train line near the traveling area of the mobile unit 10 is canceled and, therefore, the station on that train line is crowded, the setting unit 60 derives a traveling route that does not pass in front of the station on that train line and, in addition, derives a slow traveling speed at which the mobile unit 10 is to travel to the station of the train line. This makes it difficult for the users to move to the station that is crowded due to the cancellation of operation, thereby reducing an increase in crowding at the station. When the operation cancellation is resolved and the operation is resumed, the setting unit 60 sets a traveling route to carry the users to the station. The traveling information that is set by the setting unit 60 is sent to the mobile unit 10 for controlling the traveling of the mobile unit 10. The traveling information that is set by the setting unit 60 may be held in the server device 12 in advance or may be newly calculated by the setting unit 60.

The setting unit 60 determines whether the station is crowded, based on one of the images captured by the mobile unit 10, the images captured by fixed point cameras, and the operation information on transportation. The setting unit 60 analyzes the images captured inside or around a station to detect human images and, based on the number of detected human images, determines whether the station is crowded. In addition, the setting unit 60 determines whether the station is crowded, based on the operation information on transportation and the time zone information. For example, when the operation of a train line is canceled during the commuting time period for a predetermined time or more, the setting unit 60 may determine that the station is crowded.

In some cases, there is a plurality of train lines around the traveling area of the mobile unit 10 and each of the train lines has a station. In such a case, when the operation is cancelled on one of the train lines, the setting unit 60 derives a traveling route of the mobile unit 10 extending from the station on the train line on which the operation is canceled to the station on a train line on which the operation is not canceled. The traveling route derived in this way makes it possible to guide the users from the station that is crowded due to the operation cancellation to the station of the train line on which the operation is not canceled, thus resolving congestion at the station.

The setting unit 60 derives the traveling route of the mobile unit 10 based on the destination information, acquired by the acquisition unit 58, and the operation information on transportation. When the acquisition unit 58 acquires the occupant's destination information, the setting unit 60 derives a traveling route along which the mobile unit 10 can move to the station that is one of the plurality of stations around the traveling area of the mobile unit 10 and from which the occupant can reach the destination sooner, based on the operation information on transportation. Note that the occupant's destination information is specified by the name of a station far from the traveling area of the mobile unit 10. The traveling route derived in this way will guide the occupant to the destination sooner.

The mobile unit 10 may function as a store with commercial products. The setting unit 60 may detect the number of potential customers around the mobile unit 10 based on the captured images acquired by the acquisition unit 58 and, according to the detection result, may set the traveling speed of the mobile unit 10. For example, when the area around the mobile unit 10 is crowded with potential customers, the setting unit 60 may reduce the traveling speed of the mobile unit 10 or may set the speed to zero. Setting the traveling speed in this way makes it easier for potential customers to purchase commercial products on the mobile unit 10.

The setting unit 60 may derive a potential-customer presence level index indicating whether there are potential customers around the mobile unit 10 and, according to the derived index, may set the traveling speed of the mobile unit 10. For example, the potential-customer presence level index is set in four levels, "small", "medium", "many", and "very many", according to the number of potential customers.

Potential customers are persons staying around the mobile unit 10. For example, persons heading for the ticket gate of a station or persons leaving the station are not potential customers but persons staying in front of the station are potential customers. The setting unit 60 analyzes the captured images to detect human images, tracks the human images included in the captured images in chronological order, and determines whether the persons are staying in front of the station. For example, when the station is crowded due to a train operation cancellation, there are more staying persons and therefore more potential customers are detected. The potential-customer presence level index may be derived based on the number of human images included in the captured images or may be derived based on the operation information on transportation and the time zone information.

Furthermore, the setting unit 60 may derive the number of potential customers or the potential-customer presence level index based not only on the images captured by the mobile unit 10 but also on the images captured by fixed-point cameras installed in the facilities. The setting unit 60 identifies the mobile unit 10 positioned around a fixed-point camera based on the position information on the fixed-point camera, and derives whether there are many potential customers around the mobile unit 10.

When there is a plurality of mobile units 10 in the traveling area each functioning as a moving store, the setting unit 60 may derive a traveling route that allows the moving-store mobile units 10 to collect at the location around the mobile unit 10 for which a potential-customer presence level index greater than a predetermined value has been derived. The setting unit 60 derives a traveling route that allows a plurality of mobile units 10 to collect at a location where the potential-customer presence level index equal to or greater than a predetermined value has been derived. The traveling route derived in this way allows the moving-store mobile units 10 to collect at a place where there are many potential customers and, therefore, the commercial products will sell well.

First Embodiment

Figure 5:
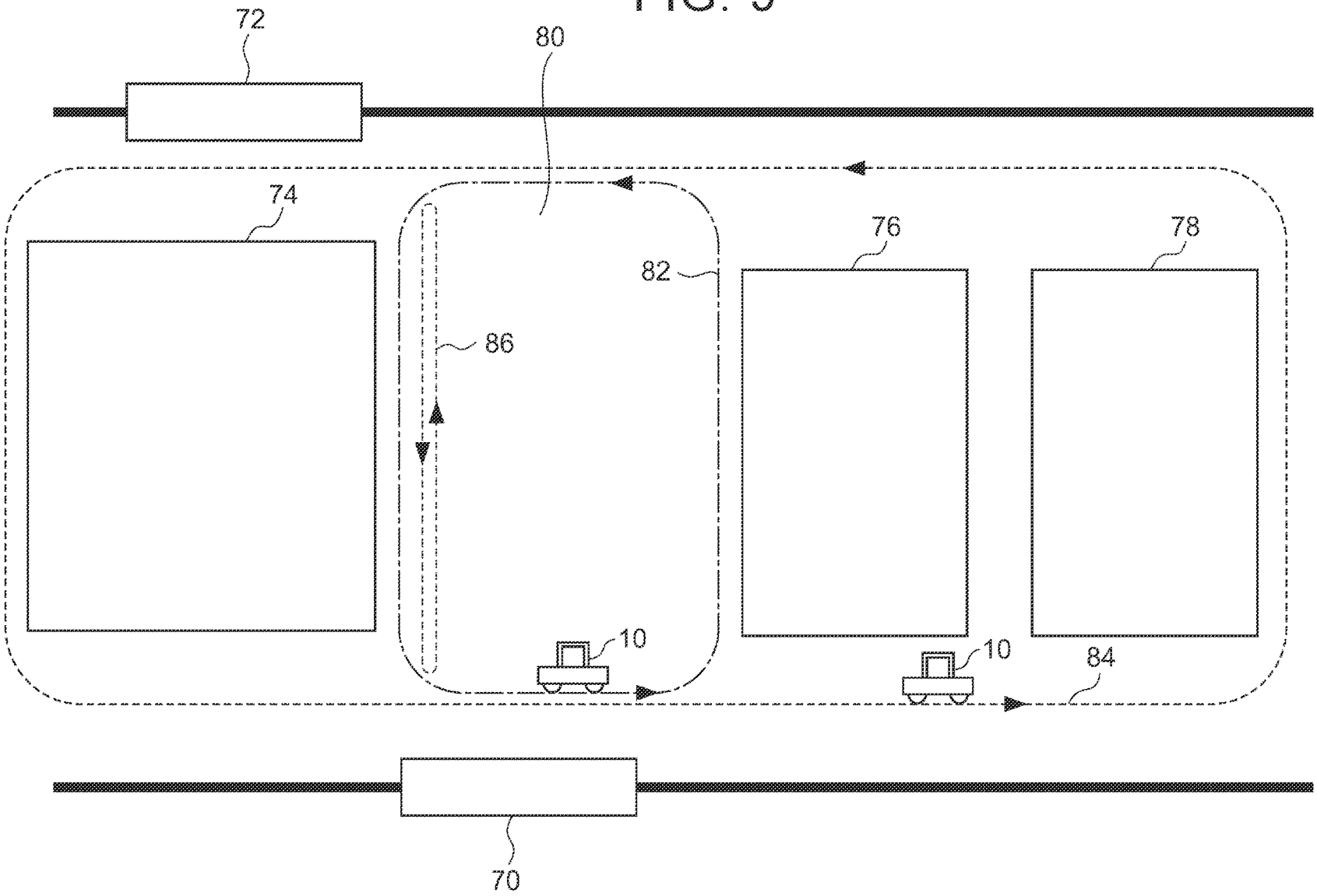
FIG. 5 is a diagram showing a mobile unit control system in a first embodiment.

FIG. 5 is a diagram showing the mobile unit control system 1 in a first embodiment. FIG. 5 shows a map in which a first complex 74, a second complex 76, a third complex 78, and a square 80 are provided between a first station 70 and a second station 72. The transportation train line passing through the first station 70 and the transportation train line passing through the second station 72 are different. The areas between and around the complexes and the area in the square 80 are set as the areas where the mobile unit 10 can travel.

The first complex 74, the second complex 76 and the third complex 78 include facilities such as shops, restaurants, cultural facilities, sports facilities, movie theaters, hospitals, and the like. The square 80, which is a station square, is provided between the first complex 74 and the second complex 76, and the mobile unit 10 travels around the square 80 along a first traveling route 82. Users can get on and off the mobile unit 10 freely. The mobile unit 10 traveling around the square 80 may travel not only on the first traveling route 82 along the outer edge of the square 80 but also on a free route in the square 80. In the square 80, the mobile unit 10 may approach or avoid pedestrians or may stop. In addition, the mobile unit 10 travels along a second traveling route 84 that travels around the complexes.

A plurality of the mobile units 10 usually travel along the first traveling route 82 or the second traveling route 84. When the operation of the train line passing through the first station 70 or the second station 72 is cancelled, the station of the train line where the operation is canceled is crowded. Thus, when the operation of any one of the plurality of train lines located around the traveling area of the mobile unit 10 is canceled, the setting unit 60 derives a third traveling route 86 extending from the station of the train line where the operation has been canceled to the station of the train line where the operation is not canceled. The information on train operation cancellation can be derived from the operation information.

The third traveling route 86 is the shortest route through which the mobile unit 10 moves between the first station 70 and the second station 72 and, therefore, the vehicle 10 travels a shorter distance between the first station 70 and the second station 72 than when traveling on the first traveling route 82 or the second traveling route 84. The traveling information on the derived third traveling route 86 is sent to the mobile units 10 traveling on the first traveling route 82 and the second traveling route 84, and the traveling control unit 32 sets the traveling route so that the mobile units 10 will travel along the third traveling route 86. Thus, when one of the stations is crowded, it is possible to guide the users to the other station to reduce crowding at the station. When the operation cancellation of the train is ended and the operation is resumed, the setting unit 60 resets the traveling route of the mobile units 10 back to the first traveling route 82 and the second traveling route 84.

The setting unit 60 may set the traveling speed of the mobile units 10 faster on the third traveling route 86, which is derived at the time of operation cancellation, than on the first traveling route 82. For example, the traveling speed on the first traveling route 82 is set at 3 km/h while the traveling speed on the third traveling route 86 is set at 5 km/h. By doing so, users who move between the first station 70 and the second station 72 can be transported quickly.

Second Embodiment

Figure 6:
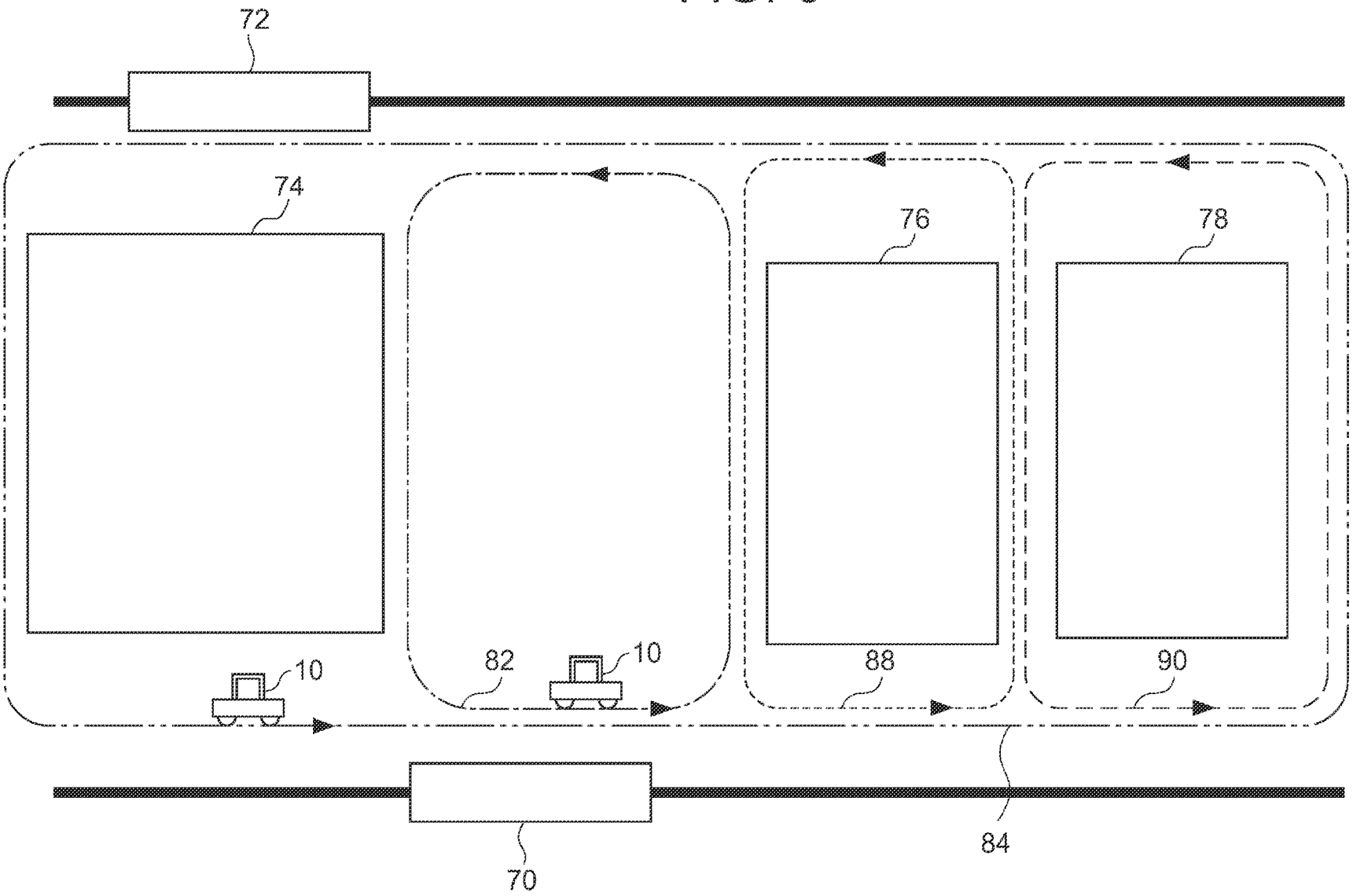
FIG. 6 is a diagram showing a mobile unit control system in a second embodiment.

FIG. 6 is a diagram showing the mobile unit control system 1 in a second embodiment. A plurality of the mobile units 10 usually travel along the first traveling route 82 or the second traveling route 84. In this embodiment, when the second station 72 is crowded, the setting unit 60 derives a third traveling route 88 and a fourth traveling route 90 so that the mobile unit 10 changes the traveling routes from the first traveling route 82 and the second traveling route 84 to the third traveling route 88 and the fourth traveling route 90.

Based on the operation information on transportation or the captured images acquired from the mobile units 10, the setting unit 60 derives that the second station 72 is crowded and then derives the third traveling route 88 and the fourth traveling route 90 that do not pass in front of the congested second station 72. That the second station 72 is crowded may be derived from the information on an operation cancellation of, or a delay in, the train line passing through the second station 72 or may be derived from the number of people in the station premises that is obtained by analyzing the captured images captured by the capturing unit 42 of the mobile units 10. When an operation cancellation or a delay occurs on the train line passing through the second station 72, it is estimated that the second station 72 is crowded.

The information on the third traveling route 88 and the fourth traveling route 90, which have been derived, is sent to the plurality of the mobile units 10 traveling on the first traveling route 82 or the second traveling route 84. The traveling control unit 32 of each of the mobile units 10 traveling on the first traveling route 82 or the second traveling route 84 switches the traveling route to the third traveling route 88 and the fourth traveling route 90. Switching the route in this way prevents the mobile unit 10 from traveling to the location in front of the second station 72, meaning that the occupants cannot arrive at the second station 72 while riding on the mobile unit 10. This keeps the users around the second complex 76 and the third complex 78, reducing the number of users heading for the crowded second station 72 and preventing the second station 72 from becoming more crowded. When the crowding of the second station 72 is resolved, the setting unit 60 resets the traveling route of the mobile unit 10 back to the first traveling route 82 and the second traveling route 84.

In another modification, the mobile unit control system 1 derives a traveling route for moving to one of a plurality of stations located around the traveling area of the mobile unit 10 according to the occupant's destination information. More specifically, in the mobile unit 10, the reception unit 36 receives an input of the name of a station away from the traveling area of the mobile unit 10 as the occupant's destination information and sends the received user's destination information to the server device 12 via the communication unit 28. In the server device 12, the acquisition unit 58 acquires the occupant's destination information. Then, the setting unit 60 derives a traveling route for moving to one of the first station 70 and the second station 72 based on the position information on the mobile unit 10 on which the occupant rides, the occupant's destination information, and the operation information on transportation. In deriving a traveling route, the setting unit 60 determines a station from which the occupant can reach the occupant's destination quickly from the current position based on the operation information on transportation and, then, derives a route to the determined station. Deriving a traveling route in this way allows the mobile unit 10 to guide the occupant to a station that will take the occupant to the destination quickly.

Third Embodiment

Figure 7:
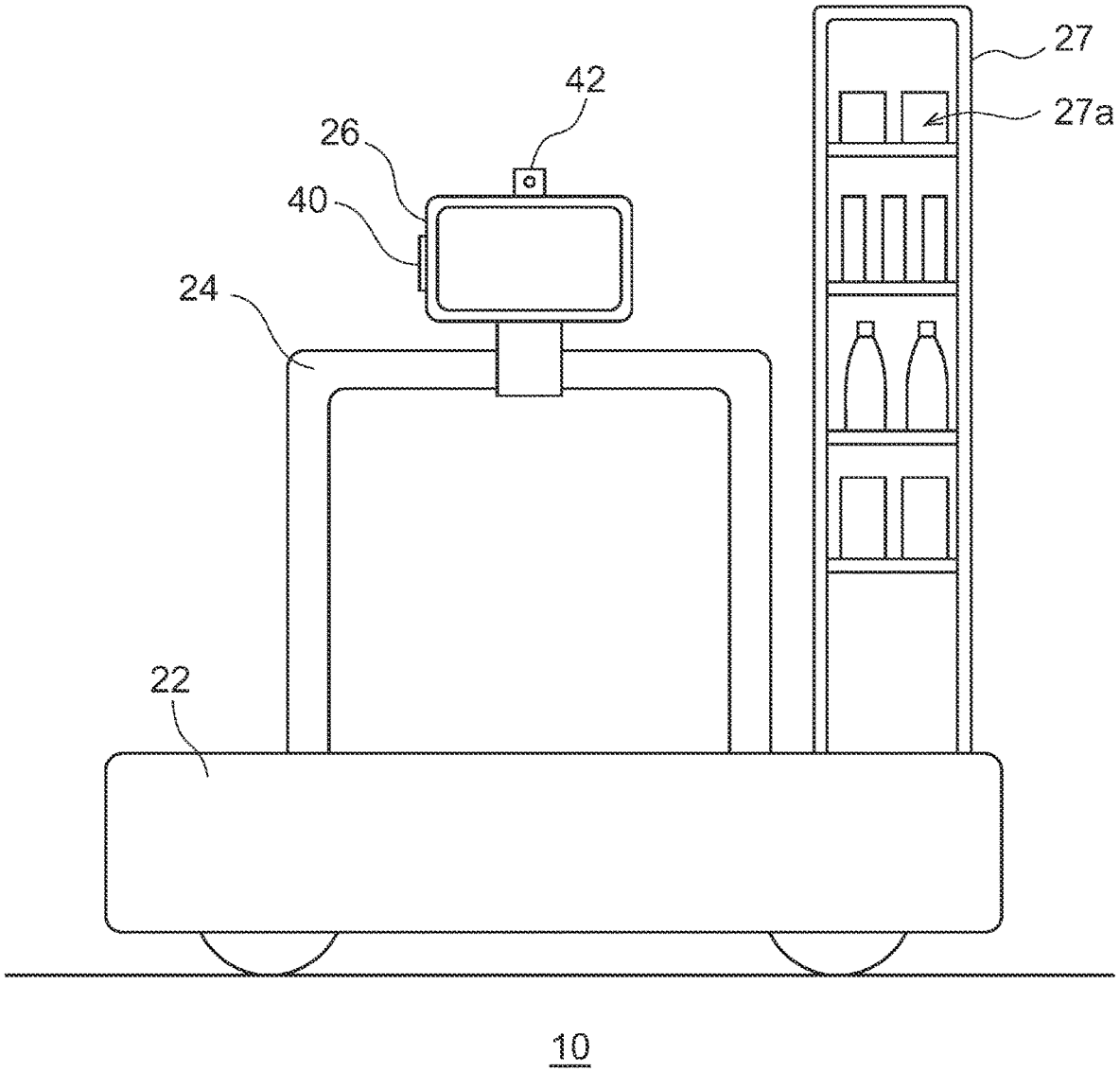
FIG. 7 is a diagram showing a mobile unit in a third embodiment.

FIG. 7 is a diagram showing the mobile unit 10 in a third embodiment. The mobile unit 10 in the third embodiment carries a shelf 27 fixed on the vehicle body 22 and a plurality of types of commercial products 27*a* arranged on the shelf 27. The mobile unit 10 such as the one described above functions as a store that sells commercial products 27*a*. An occupant pays for the commercial products 27*a* through the short-range wireless communication unit 40 to purchases the commercial products 27*a*. Although FIG. 7 shows an example in which the commercial products 27*a* are sold unmanned, a sales person may ride on the mobile unit 10.

The store-type mobile unit 10 captures the surroundings using the capturing unit 42. The server device 12 analyzes this captured image for deriving the number of potential customers around the mobile unit 10 and the potential-customer presence level index. Note that potential customers include those who are staying around the mobile unit 10 but do not include those who are walking past the mobile unit 10.

The traveling control unit 32 of the mobile unit 10 derives the traveling speed of the mobile unit 10 according to the detection result of potential customers. When the number of potential customers around the mobile unit 10 or the index is equal to or greater than the predetermined threshold, that is, when there are many potential customers around the mobile unit 10, the traveling control unit 32 reduces the traveling speed of the mobile unit 10. For example, the mobile unit 10 travels at 4 km/h when there are few potential customers, and travels at 3 km/h or less when there are many potential customers. This will make it easier for customers to purchase since the store-type mobile unit 10 travels slowly in places with many potential customers.

In addition, the traveling control unit 32 may set the traveling speed according to the number of potential customers or the index, and may set the traveling speed to be slower as the number of potential customers increases. For example, the traveling control unit 32 sets the traveling speed at 3 km/h when the number of potential customers or the index is equal to or greater than the first threshold, sets the traveling speed at 1.5 km/h when the number of the potential customers or the index is equal to or greater than the second threshold, and sets the traveling speed at 0 km/h when the number of potential customers or the index is equal to or greater than the third threshold. This makes it easier for potential customers to purchase commercial products 27*a* from the store-type mobile unit 10. The number of potential customers increases in the order from the first threshold to the third threshold.

When the number of potential customers or the index is equal to or greater than a predetermined value, the setting unit 60 of the server device 12 may derive the captaining point from the position information on the mobile unit 10 and may derive a traveling route to allow the store-type mobile units 10 to collect at the capturing position. That is, the setting unit 60 collects the store-type mobile units 10 at the place where there are many potential customers. This allows a plurality of store-type mobile units 10 to collect at a place crowded with potential customers, responding to the need of a plurality of customers who want to purchase commercial products.

It is to be understood by those skilled in the art that the embodiments are merely examples, that various modifications can be made by combining the components, and that such modifications are also within the scope of the present disclosure.

Although the mobile unit 10 automatically travels in the embodiments based on the position information obtained by the GPS, the present disclosure is not limited to this mode. For example, another mode is also possible in which a belt is stuck on the road surface along a preset traveling lane to allow the mobile unit 10 to travel on the belt. The mobile unit 10 may travel by following the belt based on the magnetic wave output from the belt or may travel by following the belt detected by image analysis.

Although the server device 12 sets the traveling information on the mobile unit 10 based on the operation information in the embodiments, the present disclosure is not limited to this mode. For example, the mobile unit 10 may set the traveling information based on the operation information. That is, in this case, the acquisition unit 58 and the setting unit 60 of the server device 12 are provided in the mobile unit 10.

What is claimed is:

1. A mobile unit control system comprising:

an acquisition unit configured to acquire operation information on transportation located around a traveling area of a mobile unit that a user gets on and off while the mobile unit is traveling; and a setting unit configured to set a traveling route of the mobile unit based on the operation information on transportation and determine whether the operation information on transportation includes information on an operation cancellation of a plurality of train lines around the traveling area of the mobile unit, wherein, when the operation of one of a plurality of train lines around the traveling area of the mobile unit is canceled, the setting unit sets the traveling route such that the traveling route extends from a station on the train line where the operation is canceled to a station on a train line where an operation is not cancelled, and the mobile unit automatically travels to the station on the train line where the operation is not canceled.

2. The mobile unit control system according to claim 1, wherein, when a station located around the traveling area of the mobile unit is crowded, the setting unit sets a traveling route that does not pass in front of the station that is crowded.

3. The mobile unit control system according to claim 1, wherein the acquisition unit is further configured to acquire destination information on an occupant riding on the mobile unit, and the setting unit is further configured to set a traveling route along which the mobile unit moves to one of a plurality of stations located around the traveling area of the mobile unit based on the destination information on the occupant and the operation information on transportation.

4. The mobile unit control system according to claim 1, wherein the setting unit is further configured to set a traveling speed of the mobile unit based on the operation information on transportation.

5. The mobile unit control system according to claim 1, wherein the traveling route extending from the station on the train line where the operation is canceled to the station on the train line where the operation is not canceled is a first traveling route, and the first traveling route is a shortest route through which the mobile unit moves between the station on the train line where the operation is canceled to the station on the train line where the operation is not canceled.

6. The mobile unit control system according to claim 5, wherein a traveling speed of the mobile unit is set to be faster on the first traveling route than on a predetermined traveling route.

7. The mobile unit control system according to claim 1, wherein the setting unit sets the traveling route to a predetermined traveling route, when the operation cancellation of the train is ended.

8. A mobile unit control method comprising:

acquiring operation information on transportation located around a traveling area of a mobile unit that a user gets on and off while the mobile unit is traveling;

setting a traveling route of the mobile unit based on the operation information on transportation; and determining whether the operation information on transportation includes information on an operation cancellation of a plurality of train lines around the traveling area of the mobile unit, wherein, when the operation of one of a plurality of train lines around the traveling area of the mobile unit is canceled, the traveling route is set extending from a station on the train line where the operation is canceled to a station on a train line where an operation is not cancelled, and the mobile unit automatically travels to the station on the train line where the operation is not canceled.

9. The mobile unit control method according to claim 8, wherein the setting step includes setting a traveling speed of the mobile unit based on the operation information on transportation.

10. The mobile unit control method according to claim 8, wherein the traveling route extending from the station on the train line where the operation is canceled to the station on the train line where the operation is not canceled is a first traveling route, and the first traveling route is a shortest route through which the mobile unit moves between the station on the train line where the operation is canceled to the station on the train line where the operation is not canceled.

11. The mobile unit control method according to claim 10, wherein a traveling speed of the mobile unit is set to be faster on the first traveling route than on a predetermined traveling route.

12. The mobile unit control method according to claim 8, wherein the setting step includes setting the traveling route to a predetermined traveling route, when the operation cancellation of the train is ended.

* * * * *